US011555347B2

(12) United States Patent
Kronenberg

(10) Patent No.: US 11,555,347 B2
(45) Date of Patent: Jan. 17, 2023

(54) PLUG CONNECTOR AND PLUG CONNECTION

(71) Applicant: Ralf M. Kronenberg, Haan / Rhld. (DE)

(72) Inventor: Ralf M. Kronenberg, Haan / Rhld. (DE)

(73) Assignee: Ralf M. Kronenberg, Haan (DE)

( * ) Notice: Subject to any disclaimer, the term of this patent is extended or adjusted under 35 U.S.C. 154(b) by 670 days.

(21) Appl. No.: 16/491,801

(22) PCT Filed: Mar. 7, 2018

(86) PCT No.: PCT/EP2018/055654
§ 371 (c)(1),
(2) Date: Sep. 6, 2019

(87) PCT Pub. No.: WO2018/162584
PCT Pub. Date: Sep. 13, 2018

(65) Prior Publication Data

US 2021/0131166 A1 May 6, 2021

(30) Foreign Application Priority Data

Mar. 8, 2017 (DE) ..... 20 2017 101 315.4

(51) Int. Cl.
*E06B 3/667* (2006.01)

(52) U.S. Cl.
CPC ..... *E06B 3/667* (2013.01)

(58) Field of Classification Search
CPC .... E06B 3/66314; E06B 3/667; F16B 7/0446; F16B 7/0413
See application file for complete search history.

(56) References Cited

U.S. PATENT DOCUMENTS

| | | | | |
|---|---|---|---|---|
| 2009/0049774 | A1* | 2/2009 | Kronenberg | E06B 3/667 52/204.591 |
| 2010/0074679 | A1* | 3/2010 | Kronenberg | E06B 3/667 403/298 |
| 2017/0342766 | A1* | 11/2017 | Thompson | E06B 3/667 |

FOREIGN PATENT DOCUMENTS

| | | | | |
|---|---|---|---|---|
| DE | 3408600 | A1 | 9/1985 | |
| DE | 94 11 067 | U1 | 9/1994 | |
| DE | 20 2006 009491 | U1 | 10/2007 | |
| DE | 202006009491 | U1 * | 11/2007 | E06B 3/667 |
| DE | 20 2007 004 924 | U1 | 8/2008 | |
| DE | 20 2014 104 222 | U1 | 12/2015 | |
| DE | 202014104222 | U1 * | 1/2016 | E06B 3/66314 |
| EP | 1785575 | A2 * | 5/2007 | E06B 3/667 |
| EP | 3730732 | A1 * | 10/2020 | E06B 3/667 |
| WO | 2005/040538 | A1 | 5/2005 | |
| WO | WO-2017050624 | A1 * | 3/2017 | E06B 3/667 |

* cited by examiner

*Primary Examiner* — Christine T Cajilig
(74) *Attorney, Agent, or Firm* — McGlew and Tuttle, P.C.

(57) ABSTRACT

A preferably straight plug connector (1) is provided for hollow profiles (23), in particular warm edge hollow profiles, of spacers of insulation glazing. The plug connector (1) has a substantially U-shaped cross-section with open end faces (26) and a base (2) facing the pane inner space when installed, and has side walls (3) along its edges and a centering aid (24). Laterally flared resilient retaining elements (6, 7, 8, 9), which have a straight lower edge (11) in the side view, are mounted on the free edge (4) of the side walls (3).

29 Claims, 11 Drawing Sheets

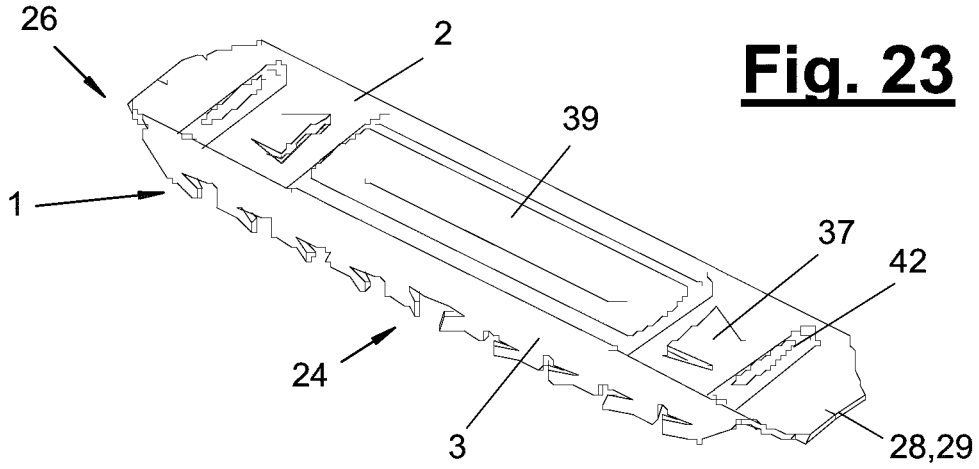
Fig. 23
Fig. 24
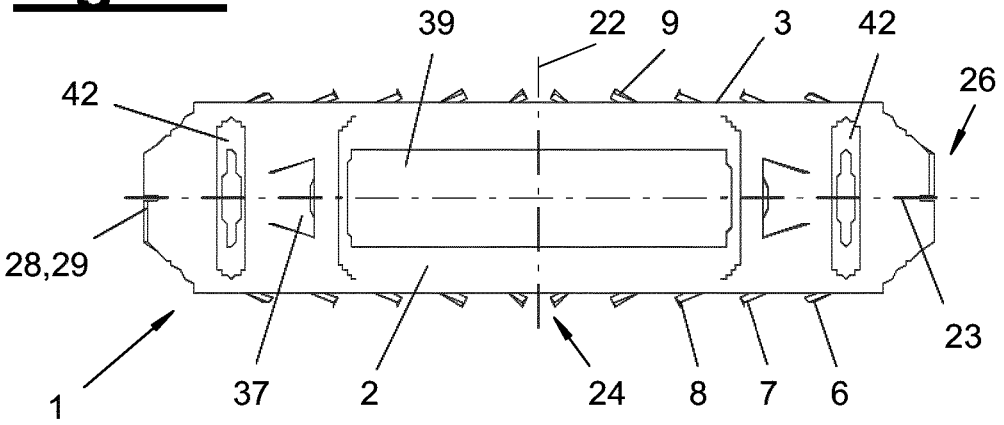
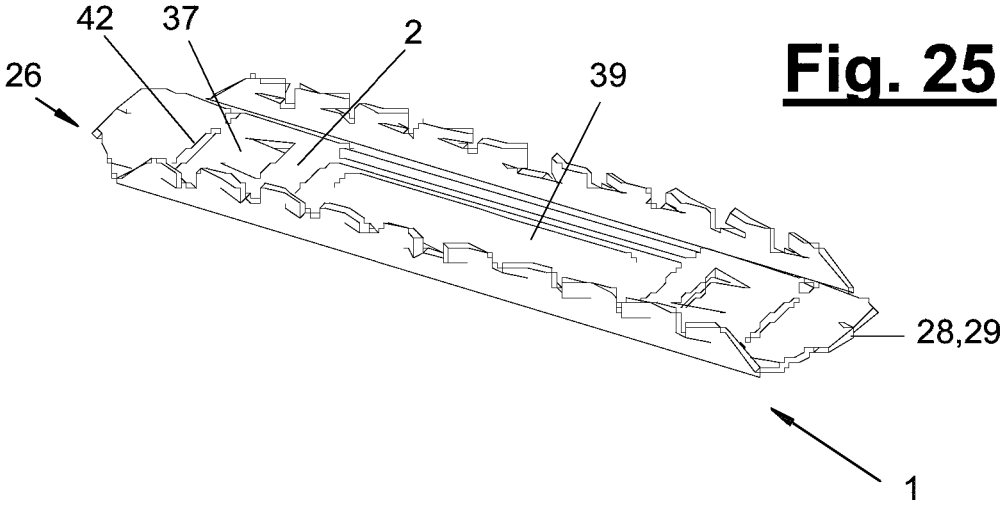
Fig. 25

PLUG CONNECTOR AND PLUG CONNECTION

CROSS REFERENCE TO RELATED APPLICATIONS

This application is a United States National Phase Application of International Application PCT/EP2018/055654, filed Mar. 7, 2018, and claims the benefit of priority under 35 U.S.C. § 119 of German Application 20 2017 101 315.4, filed Mar. 8, 2017, the entire contents of which are incorporated herein by reference.

TECHNICAL FIELD

The invention pertains to a plug connector and to a plug connection wherein the plug connector for hollow sections has an essentially U-shaped cross section with open end faces and with a base pointing towards a pane inner space when installed as well as with side walls along the edges and with a centering aid.

TECHNICAL BACKGROUND

Such a plug connector is known from DE 20 2014 104 222 U1. It is intended for warm-edge hollow sections of spacers of an insulating glazing and has an essentially U-shaped cross section with a base, with side walls along the edges and with a central stop, as well as with laterally flared retaining elements at the free edge of the side walls. The retaining elements have a flexible configuration, and a wall opening is located under the retaining elements, and the retaining elements have a wedge shape, which widens towards the center of the connector.

SUMMARY

An object of the present invention is to show a further improved plug connection technology.

The plug connection technology being described, i.e., the plug connector and the process for manufacturing same, as well as the plug connection have various advantages.

The plug connector of the invention offers an especially good and secure hold in a hollow section made of a soft, heat-insulating material, especially a warm-edge hollow section. This hollow section consists of a plastic in at least some areas. The plug connector is also suitable with similar advantages for other types of hollow sections. The laterally flared, resilient retaining elements of the plug connector being claimed dig in optimally at the side walls of the hollow section. The flexibility of the retaining elements is lower than in the state of the art mentioned in the introduction. The retaining elements being claimed offer an especially firm and immediately acting retention when extracting forces act on the closed plug connection. Formation of a gap at the connection point of the hollow sections can be avoided with a high level of reliability.

On the other hand, the plug connector can easily be plugged into the two hollow section ends. The laterally flared, resilient retaining elements surprisingly offer a low resistance to plugging, which is favorable for plugging in manually or automatically despite their higher flexural strength. On the other hand, they act immediately in the above-mentioned manner in case of extracting forces acting in the opposite direction and prevent the hollow section ends from moving mutually away from the connection point.

The claimed arrangement and shaping of the laterally flared retaining elements is especially favorable for the aforementioned functions and for the plugging effect achieved. The resistance to extraction, on the one hand, and the resistance to plugging, on the other hand, are balanced optimally.

The lower edge of the retaining elements is straight and it no longer has the undercut and the large opening at the bending point as in the aforementioned state of the art. The straight front edge of the retaining elements is oriented parallel to the preferably obliquely flared principal plane of the corresponding side wall. The rectangular shape of the retaining elements is also advantageous here for said functions. The retaining elements may have a uniform, especially rectangular shape among themselves. The dimensions may vary.

When the plug connector is being plugged in, said front edges of the retaining elements slide along the hollow section wall, and rotations of the retaining elements about the longitudinal axis can be prevented from occurring. The rectangular shape and the markedly greater length of the retaining elements compared to the height likewise have a favorable effect.

The resilient and obliquely outwardly flared retaining elements can be deformed during the plugging into the hollow sections and can be flared to a certain extent. The retaining elements with their front edges can now mesh optimally with the adjacent lateral section wall. Due to the straight lower edge and possibly to the narrow straight parting cut, the retaining elements have an especially good strength against extracting forces and they dig linearly and optimally with their straight front edge into the side wall of the section.

A free space between the front edge or front side of the retaining elements and the wall attachment of the retaining element located closest in the axial or longitudinal direction is favorable for an optimal configuration of said front edge and for manufacturing the metallic plug connector configured as a stamped and bent part. The bending point or bending edge of the laterally flared retaining elements may be located directly at the end of the axial parting cut. The recess is likewise advantageous and it prevents a deformation of the front edge during the cutting out and bending out.

The retaining elements are arranged in an axial row or group of preferably four pieces at both side walls and on both sides of the center of the connector. The number may also be different, especially greater.

A preferably outwards oriented embossing on the side walls has advantages for the strength of the plug connector and for the sealing effect against the hollow section in the plugged-in position. The preferably upright embossing possibly extends over the lower, base-side part of the side wall and in some areas also over a laterally flared retaining element. The strengthening and sealing effect is also present as a result in the retaining element. The embossing may also be absent.

It is favorable for the handling and for said plugging functions if the retaining elements have the different flaring widths being claimed. The clamping effect increases with the plug-in depth as a result. The flaring width of resilient stop bosses of the centering aid may be equal to or smaller than the flaring width of the respective closest retaining element. In addition, different heights of the retaining elements over the base are advantageous. The retaining elements that are the first in the plug-in direction preferably have a smaller height than the next retaining elements. The height of the latter may be equal.

The length of the front edge or of the bending point of the retaining elements may be equal. These lengths may vary in a variant. The retaining elements located adjacent to the center of the connector may have a shorter front edge length than the other retaining elements. This is favorable for the plugging in and for the retention of the plug connector. In addition, the plug connector has a greater mechanical stability, especially flexural strength, in the middle area. In addition, the claimed arrangement of a plurality of retaining elements at each side wall and on both sides of the center of the connector is favorable.

The plug connector being claimed has a closed and especially flat base in one embodiment. This is advantageous for the aforementioned plugging effect and for the retaining function of the laterally flared retaining elements at the upper free edge of the side wall. In another embodiment, resilient retaining elements may be arranged at the base. These may also be directed outwards. Their length may be shorter than their width, especially the width at the free front edge. The retaining elements may have a conical shape, which expands towards the free front edge.

In addition, stabilization at the base tongs at the end face, especially in the form of an interconnection of the front edge of the tongue, is favorable. Blocking elements, which prevent an undesired plugging together and jamming of plug connectors, are advantageous for handling loose plug connectors. This is especially advantageous for an automated handling and preplugging of plug connectors at the ends of hollow sections.

A centering aid, especially a central stop, is favorable for making it possible to exactly position the hollow section ends plugged onto the plug connector. The centering aid may be arranged at one long side or at both long sides of the plug connector. The hollow section ends with their end faces can abut tightly against one another at the connection point with suitable, especially resilient stop elements. Gap formation and the escape of granular material at the connection or junction point can be avoided or at least minimized hereby. The elevated base areas of the plug connector on the outer side are likewise optimized for avoiding or minimizing the escape of granular material.

The plug connector is preferably configured as a stamped and bent part made of metal, especially a steel plate, which is, for example, electrolytically galvanized, or also of carbon steel or stainless steel or the like. The plug connector is preferably configured as a straight connector. As an alternative, it may, however, also be configured as a corner angle.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 23 is a lower perspective view of a fifth variant of the plug connector;

FIG. 24 is a bottom view of the fifth variant of the plug connector; and

FIG. 25 is an upper perspective view of the fifth variant of the plug connector;

DESCRIPTION OF PREFERRED EMBODIMENTS

Figure 1:
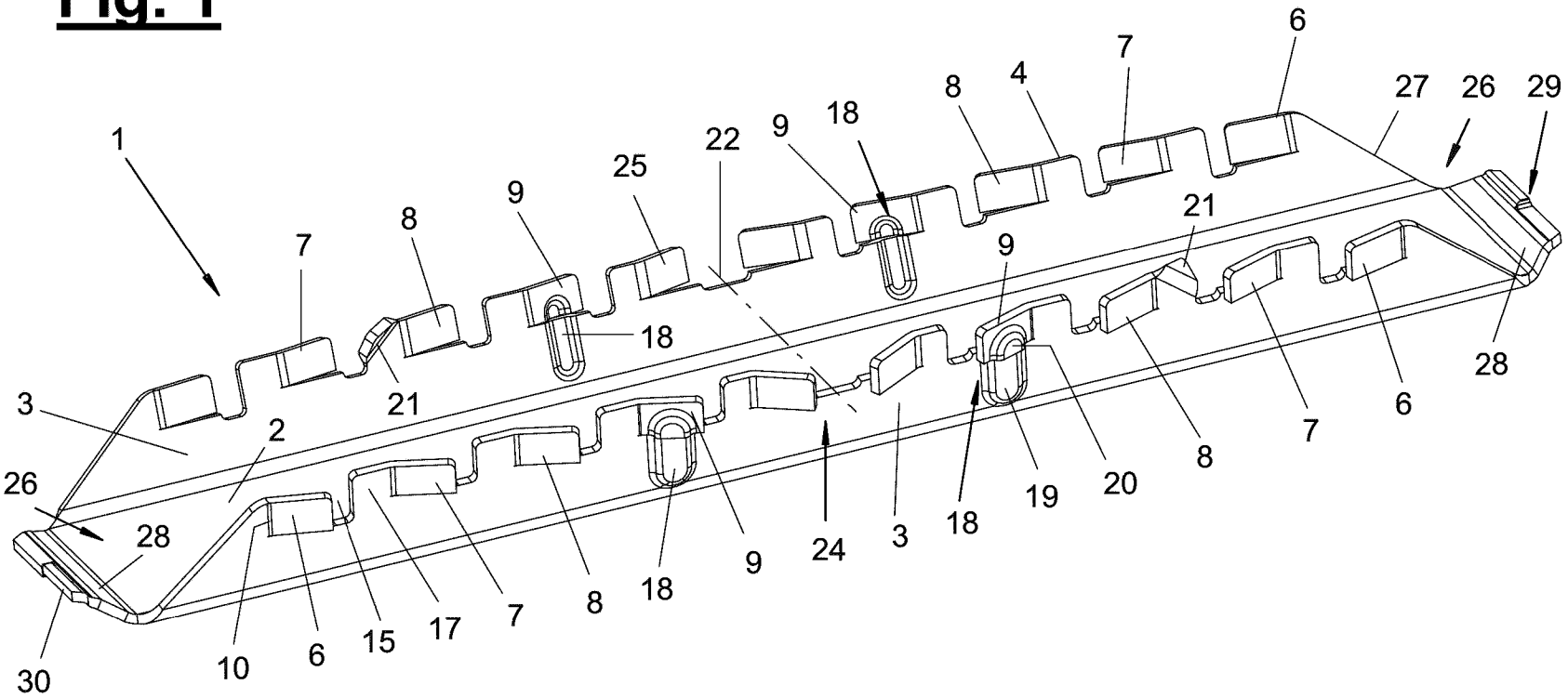
FIG. 1 is a perspective view of a first variant of the plug connector.

Referring to the drawings, the present invention pertains to a plug connector (1) and to the process for manufacturing same. The present invention further pertains to a plug connection (31) comprising a hollow section (32) and a plugged-in plug connector (1).

FIGS. 1 through 9 show the plug connector (1) in different views. The plugged-in position of the plug connector (1) into an end of a hollow section (32) is shown on one side in FIGS. 10 and 11. FIGS. 12 through 25 show four additional variants of the plug connector (1).

The plug connector (1) is configured as a straight connector in the embodiments shown. The plug connector (1) has a center (22) and connector legs projecting herefrom in different directions. The connector legs are aligned in the straight connector being shown. In case of a corner angle, they form an angle different from 180°, e.g., 90°. The plug connector (1) has, in addition, a longitudinal axis (23), which extends along its legs and at right angles to the center or center line (22).

The plug connector (1) has a base (2) with side walls (3) along the edges in the exemplary embodiments shown. In the installed position of the plug connector or in the plugged-in position (31), the base (2) points towards the section bottom (35) of the hollow section or hollow sections (32) and towards the pane inner space of the insulating glazing.

The side walls (3) adjoin the longitudinal edges of the base (2) at right angles or preferably slightly bent obliquely outwards and project in the opposite direction towards the hollow section roof (36). The base (2) and the side walls (3) enclose an inner cavity (5), which extends in the axial direction (22) up to the open front sides (26) of the plug connector (1). The cavity (5) is free and makes possible an axial flow of the granular desiccant over the junction point of the hollow section ends (32). In the embodiments shown, the plug connector (1) has an essentially U-shaped cross section, which is open upwards towards the roof (36) of the hollow section and towards the outer side of the insulating glazing.

In the exemplary embodiments shown, the plug connector (1) is configured as a stamped and bent part made of a metal plate, especially steel plate. The metal plate, especially steel strip, is preferably galvanized, e.g., electrolytically. The side walls or side webs (3) are stamped during the manufacture from a blank and are bent off from the base (2) or central web.

The preferably frame-shaped spacer of the insulating glazing may have one or more hollow sections (32). It may comprise, for example, a single, multiply bent hollow section, whose hollow section ends are plugged on both sides onto the legs of the plug connector (1). In another embodiment, the spacer (frame) may be formed from a plurality of hollow section pieces, which are connected to one another via a plugged-in plug connector (1) in a corresponding manner. The connection point may be arranged at a straight section or at a corner area of the spacer frame. The spacer (frame) spaces apart adjacent glass panes of the insulating glazing.

Figure 3:
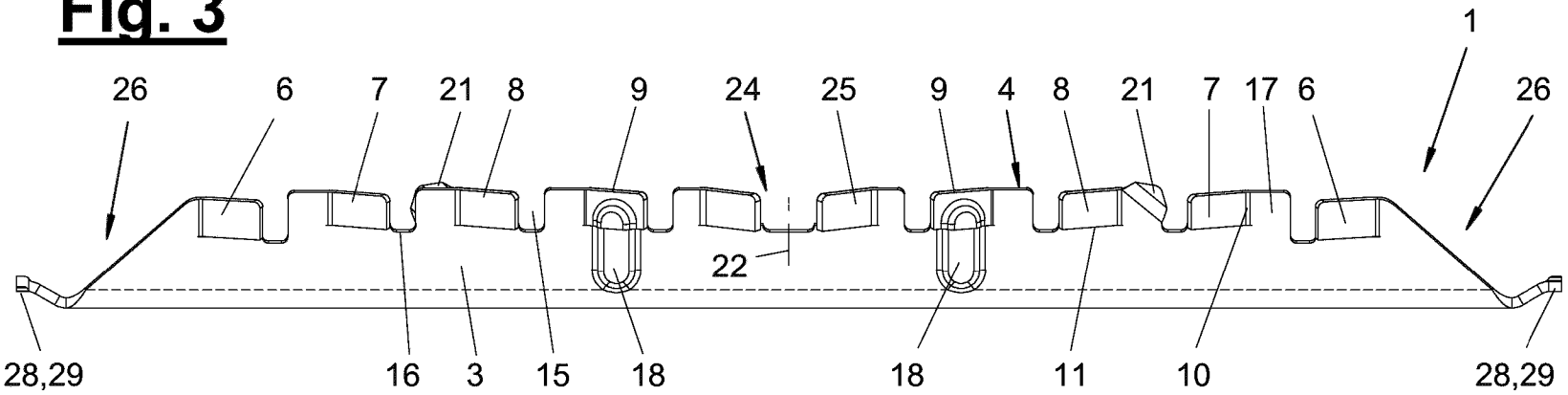
FIG. 3 is a side view of the plug connector from FIG. 1.
Figure 4:
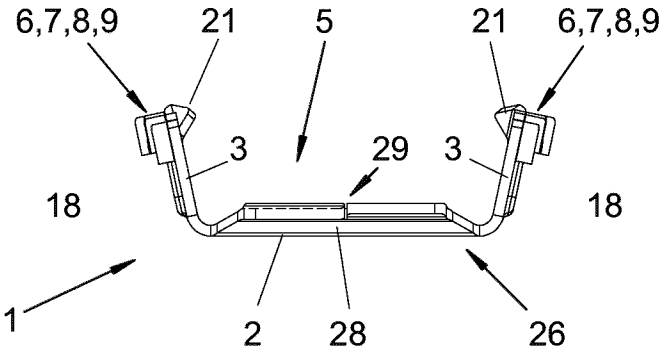
FIG. 4 is an end view of the plug connector from FIG. 1.
Figure 5:
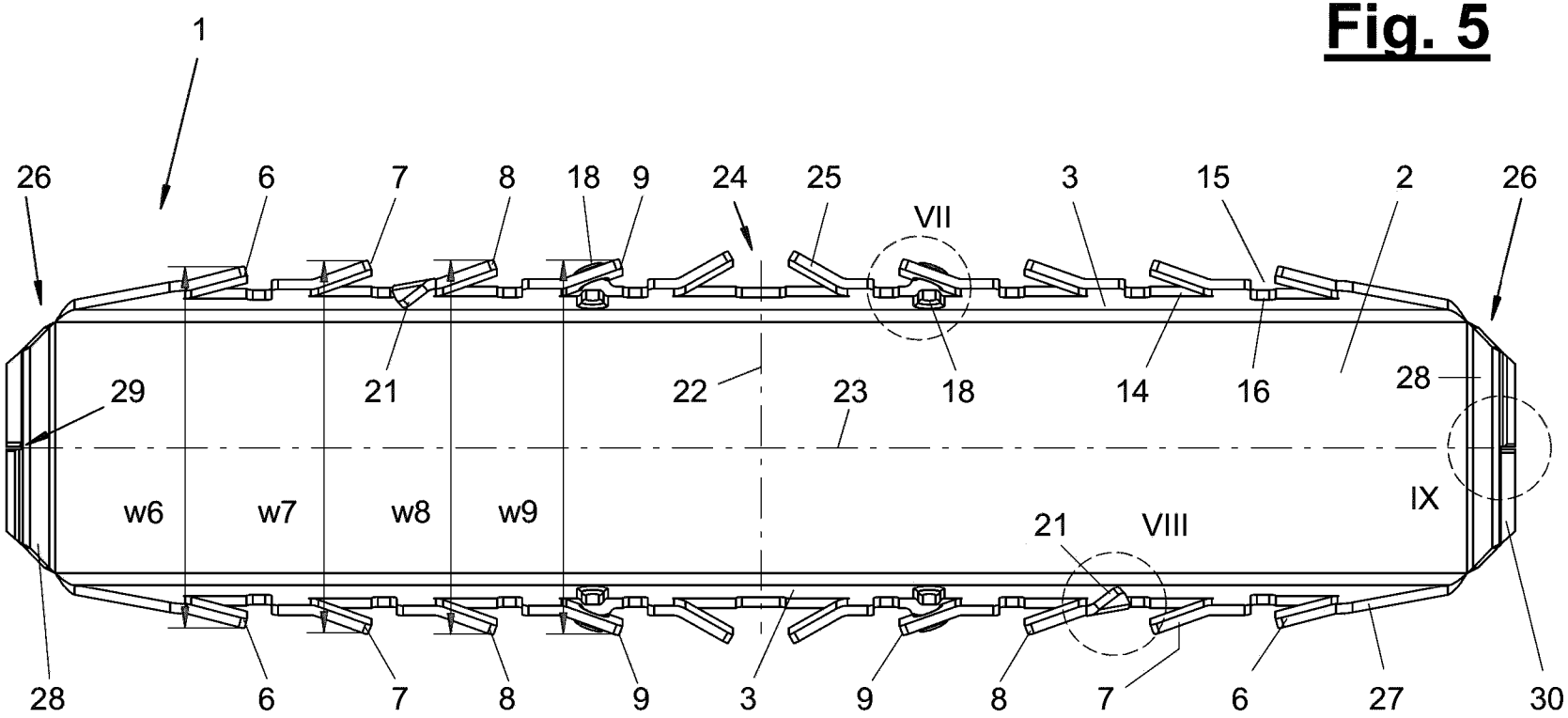
FIG. 5 is a top view of the plug connector from FIG. 1.

FIG. 1 shows the plug connector (1) in the first variant in a perspective view and FIGS. 3, 4 and 5 show it in tilted views.

The plug connector (1) in the exemplary embodiment according to FIGS. 1 through 11 has a closed and preferably flat base (2), at the end faces (26) of which base tongues (28) are arranged. The base (2) has no openings and no retaining elements. According to the front view shown in FIG. 11, it lies flat on the section bottom (35), which is likewise flat on the inner side.

At the free edge (4) of its side walls (3), the plug connector 1 has resilient retaining elements (6, 7, 8, 9), which project from their respective side wall (3) and are bent laterally obliquely outwards. These retaining elements (6, 7, 8, 9) are configured as spring bosses, which are oriented towards the center (22) of the connector starting from the side wall (3).

The two side walls (3) have a row of four retaining elements (6, 7, 8, 9) in front of and behind the center (22) of the connector when viewed in the longitudinal direction (23). The retaining elements (6, 7, 8, 9) are arranged on both sides of the longitudinal axis (23), each at the same height, and they form a pair each with one another. The two legs of the plug connector (1) have four such pairs each. The four rows or groups of retaining elements (6, 7, 8, 9) have the same configuration each.

The retaining elements (6, 7, 8, 9) are cut free from a blank with a bent, L-shaped stamping cut from the free edge area (4) of the side walls (3) and are then bent outwards. A wall attachment (17) of the side wall (3), which attachment axially adjoins the bending point (10), is left.

Figure 6:
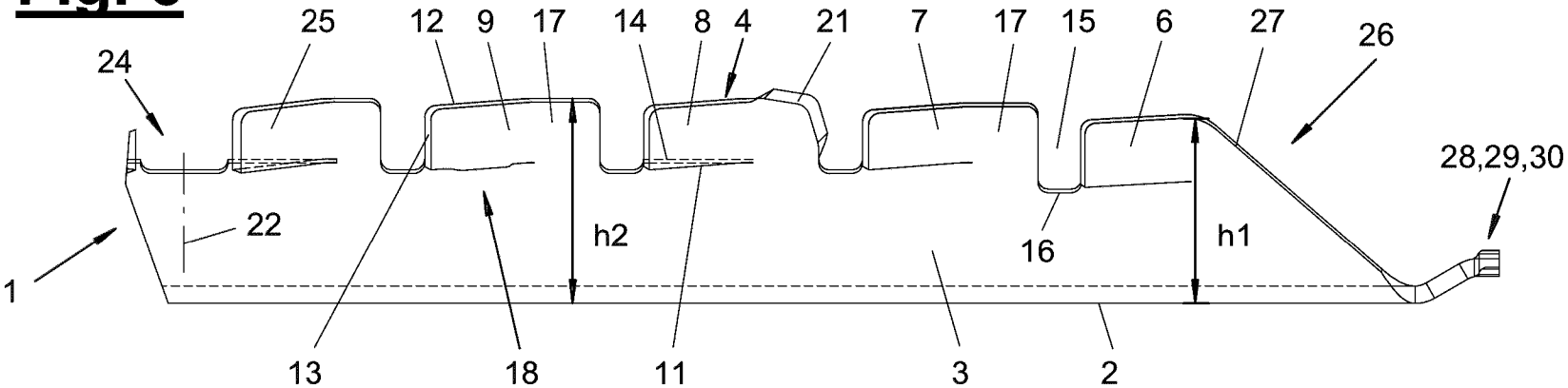
FIG. 6 is a cut-away and enlarged side view of the plug connector from FIG. 1.
Figure 9:
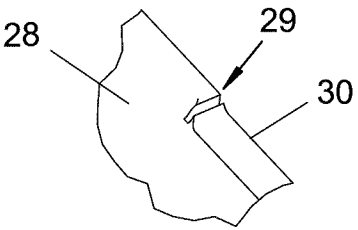
FIG. 9 is a cut-away and enlarged view of detail IX from FIG. 5.
Figure 8:
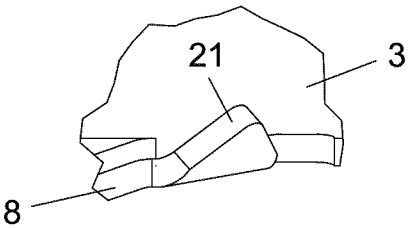
FIG. 8 is a cut-away and enlarged view of detail VIII from FIG. 5.

In the side views according to FIGS. 3 and 6, the retaining elements (6, 7, 8, 9) have a straight lower edge (11) each. The lower edge (11) extends parallel to the base (2) and to the longitudinal axis (23). The retaining elements (6, 7, 8, 9) also have a straight upper edge (12), which likewise extends parallel to the base (2). It passes over into the upper edge of the corresponding wall attachment (17). The position data of the lower edge (11) and upper edge (12) are related to the installed position and the base (2), which is now at the bottom. The lower edge (11) is arranged closer to the base (2) than the upper edge (12). The upper edge (12) is located at the free edge (4).

At the front, which is cut free, the retaining elements (6, 7, 8, 9) have a straight and upright front edge (13), which extends parallel to the principal plane of the side wall (3). The front edge (13) is oriented at right angles to the upper and lower edges (12, 11) and may be rounded at the respective edge transition. The retaining elements (6, 7, 8, 9) are bent off laterally from the respective side wall (3) about a rear bending point or bending edge (10) and are flared. The bending line (10) extends parallel to the front edge (13). The height of the retaining elements (6, 7, 8, 9) is constant over their respective lengths.

In their side view, the retaining elements (6, 7, 8, 9) have a rectangular shape, which is defined by the edges (11, 12, 13) and the bending line (10). The length of the retaining elements (6, 7, 8, 9) along the upper and lower edges (12, 11) is greater than the height of the retaining elements (6, 7, 8, 9) along the front edge (13) or the bending line (10). The length may be greater than the height by, e.g., one third or by half. The difference of the length compared to the height may, as an alternative, even be greater.

The size of the area and the edge dimensions of the retaining elements (6, 7, 8, 9) may be equal or different. In the exemplary embodiments shown, the retaining element (6) located adjacent to the front sides may have according to FIG. 6 a shorter length and a greater height than the other retaining elements (7, 8, 9). Their lengths and heights as well as area sizes may be equal to one another or differ only slightly.

The retaining elements (6, 7, 8, 9) are separated from their respective side walls (3) on their underside or lower edge (11) by a straight axial parting cut (14). This is a narrow parting cut. Its width can be determined by the necessary stamping or parting tool. The parting cut (14) extends parallel to the base (2) and to the longitudinal axis (23). The parting cut or free cut (14) reaches with one of its ends the bending line (10). It has a sharp edge. The straight and narrow parting cut (14) has a substantially smaller width than the state of the art mentioned in the introduction and it also lacks the enlarged and rounded opening at said cut end.

Adjacent to the bending point (10) and the retaining elements (6, 7, 8, 9), the side wall (3) has said wall attachment (17) in the direction of the adjacent end face (26). Further, the side wall (3) has a free space (15) each in front of the front edge (13) of the retaining elements (6, 7, 8, 9). This free space (15) is present between the front edge (13) and the upright edge of the adjacent wall attachment (17) of the next retaining element (7, 8, 9). The upright oblong free space (15) is oriented at right angles to the base (2). It is broader than the horizontal parting cut (14). The free space (15) has on the underside a recess (16) in the side wall (3), which slightly extends below the parting cut (14). This configuration is illustrated in FIGS. 3 and 4.

As is illustrated in the top view in FIG. 5, the two side walls (3) have a respective row of a plurality of, preferably four, retaining elements (6, 7, 8, 9) on both sides of the center (22) of the connector. The aforementioned pairs of retaining elements (6, 7, 8, 9), which are located opposite each other, have each a flaring width (w6, w7, w8, w9). The flaring widths (w6, w7, w8, w9) have different sizes and increase each from the end face (26) to the center (22) of the connector. The flaring widths are always related to the outermost upright edges or front edges (13) of the retaining elements (6, 7, 8, 9) and always to the upper end located at the greatest distance from the base (2).

The pair of retaining elements (6) located closest to the end face (26) has the smallest flaring width (w6). The next pairs of retaining elements (7, 8, 9) have a greater flaring width (w7, w8, w9) each. The difference in size between the flaring width (w6) and the next flaring width (w7) is greater than the respective difference between the flaring widths (w7, w8, w9). This first difference between the flaring widths (w6, w7) may equal about 1 mm. The difference in width is substantially smaller between the next flaring widths (w7, w8, w9) and equals about 0.1 mm. The flaring width (w9) located closest to the center (22) of the connector is the largest.

As is illustrated in the side views in FIGS. 3 and 6, the retaining elements (7, 8, 9) arranged at the side walls (3) and at the connector legs on both sides of the center (22) of the connector have different heights (h1, h2) above the base (2). The heights (h1, h2) are related to the distance of the lower edge of the base (2) from the upper edge (12) of the retaining elements (6, 7, 8, 9).

In the embodiments shown, the respective retaining element (6) arranged at the end face (26) has a lower height (h1) than the further retaining elements (7, 8, 9) following in the axial direction towards the center (22) of the connector. The height (h2) of these is greater than the height (h1). In addition, the parting cuts (14) and the lower edges (11) are arranged deeper at the retaining element (6) located at the end face than in the other retaining elements (7, 8, 9).

The other retaining elements (7, 8, 9) may have an equal height (h2) each. Their straight upper edges (12) and the likewise straight upper edges of their wall attachments (17) as well as the lower edges (11) are all at the same height. As an alternative, the height of the retaining elements (7) may be somewhat smaller and represent an intermediate height. The difference between the heights (h1) and (h2) may equal, e.g., about 0.3 mm.

Figure 7:
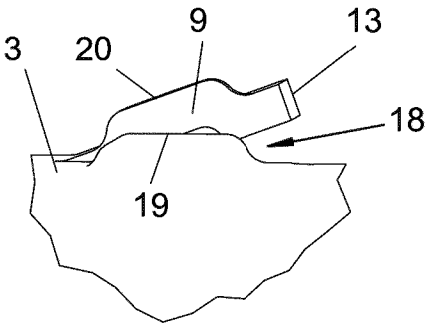
FIG. 7 is a cut-away and enlarged view of detail VII from FIG. 5.

As is illustrated in FIGS. 1 through 5 as well as in the detail view in FIG. 7, the side walls (3) may have an embossing (18) each on both sides of the center (22) of the connector. Four embossings (18) of the same kind are present in a centrally symmetrical arrangement at the two connector legs. The tub-like embossings (18) are each oriented outwards and preferably have an oblong and upright shape directed at right angles to the base (2). The material of the side wall bulges out to the outside and may be flat or slightly arched in the middle bulging area.

The embossings (18) are arranged each in the area of a retaining element. They are preferably located at the retaining element (9) located closest to the center (22) of the connector. The embossings (18) are formed in the blank during the manufacture of the connector before the bending and lateral flaring of the retaining element (9).

Figure 2:
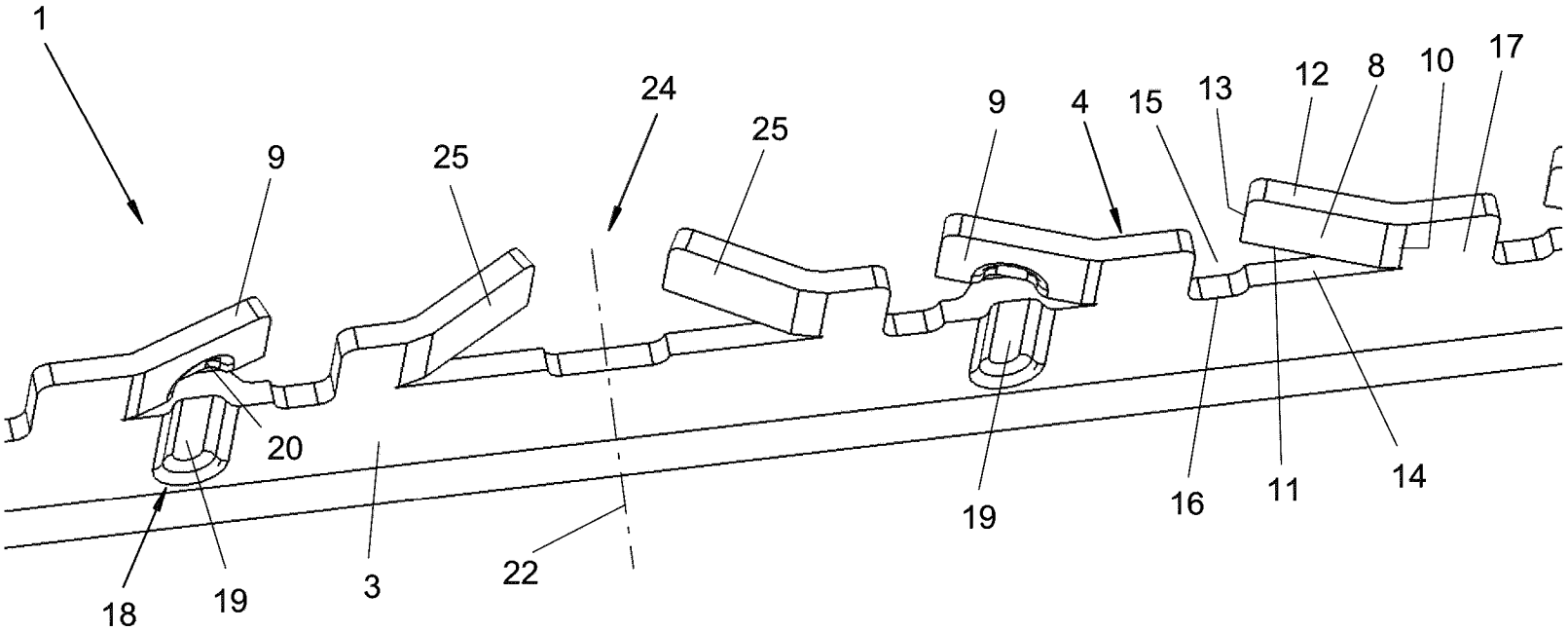
FIG. 2 is a cut-away and perspective detail view of a side wall area of the plug connector from FIG. 1.

The embossing (18) is interrupted by the parting cut (14). The embossing (18) has an embossed area (19) at the side wall (3) and an embossed area (20) at the flared retaining element (9). Viewed in the longitudinal direction (23), the embossed areas (19, 20) are laterally offset in relation to one another due to said flaring. FIG. 2 shows this configuration. FIG. 7 shows the embossing (18) with viewing direction from the base (2).

The plug connector (1) may have an inwardly directed blocking element (21) each at the side walls (3). As is illustrated by FIGS. 5 and 6 as well as the detail shown in FIG. 8, the blocking element (21) is configured as a cam, which is bent off and is directed towards the cavity (5), and is arranged at a wall attachment (17) after a retaining element (8).

A blocking element (21) each is arranged at the side walls (3). The blocking elements (21) are located on different legs and are arranged diagonally offset in relation to the center (22) of the connector. The blocking elements (21) constrict the access into the cavity (5) from the top and prevent plug connectors (11) from mutually dipping and nesting in a position one on top of another.

The base tongues (28) have a stabilizing element (29) each. The stabilizing element (29) acts mechanically and reinforces the outer or front edge (30) of the tongue. The stabilizing element (29) may be configured, e.g., as an interconnection according to FIGS. 5 and 9. A parting cut is made here in the edge (30) of the tongue centrally and in the longitudinal direction (23), and the tongue edge sections formed are then interconnected and are bent downward and upward opposite each other.

The plug connector (1) has a centering aid (24), which is configured, e.g., as a central stop with fixed and/or resilient stop elements (25) for the plugged-in hollow section ends (32). There are different embodiment variants for this.

In the embodiment shown, the stop elements (25) are arranged at one side wall and preferably at both side walls (3). They are configured each as spring bosses, which are bent out against one another in pairs and are flared to the outside. They are arranged such that they are located opposite each other in pairs on both sides of the center (22) of the connector. They are, in addition, spaced apart from one another axially on their front sides. The stop elements (25) are arranged, e.g., at the free edge area (4) of the side walls (3). They may be cut out from the respective side wall and bent obliquely outwards. FIGS. 2 and 3 show the details of the central stop (24) and the stop elements (25) thereof.

A hollow section end (32) pushed over a connector leg crosses the first elastically yielding stop element (25) and strikes the end face of the second stop element (25), which is directed opposite and acts as a stop, beyond the center (22). The second hollow section end (32) pushed over from the opposite side then strikes at the end face the first hollow section end (32). The junction point of the two hollow section ends (32) is located in the area of the center (22) of the plug connector (1) and is covered and sealed by the plate-like base (2) at least in the area of the base.

In another embodiment of the central stop (24), a spring boss may be combined with a fixed stop located opposite beyond the center (22). Further, it is possible to use simple fixed stops, especially fixed stops in the form of a ramp or wedge. These may be arranged at the side walls (3), e.g., on one side and diagonally offset over the center. In addition, fixed ministops of a triangular or rib shape are possible. In another variant, a centering aid (24) may also be arranged in another location of the plug connector (1). The corner area is correspondingly widened and reinforced in the case of a corner angle to form a stop for the attached hollow sections (32).

Figure 10:
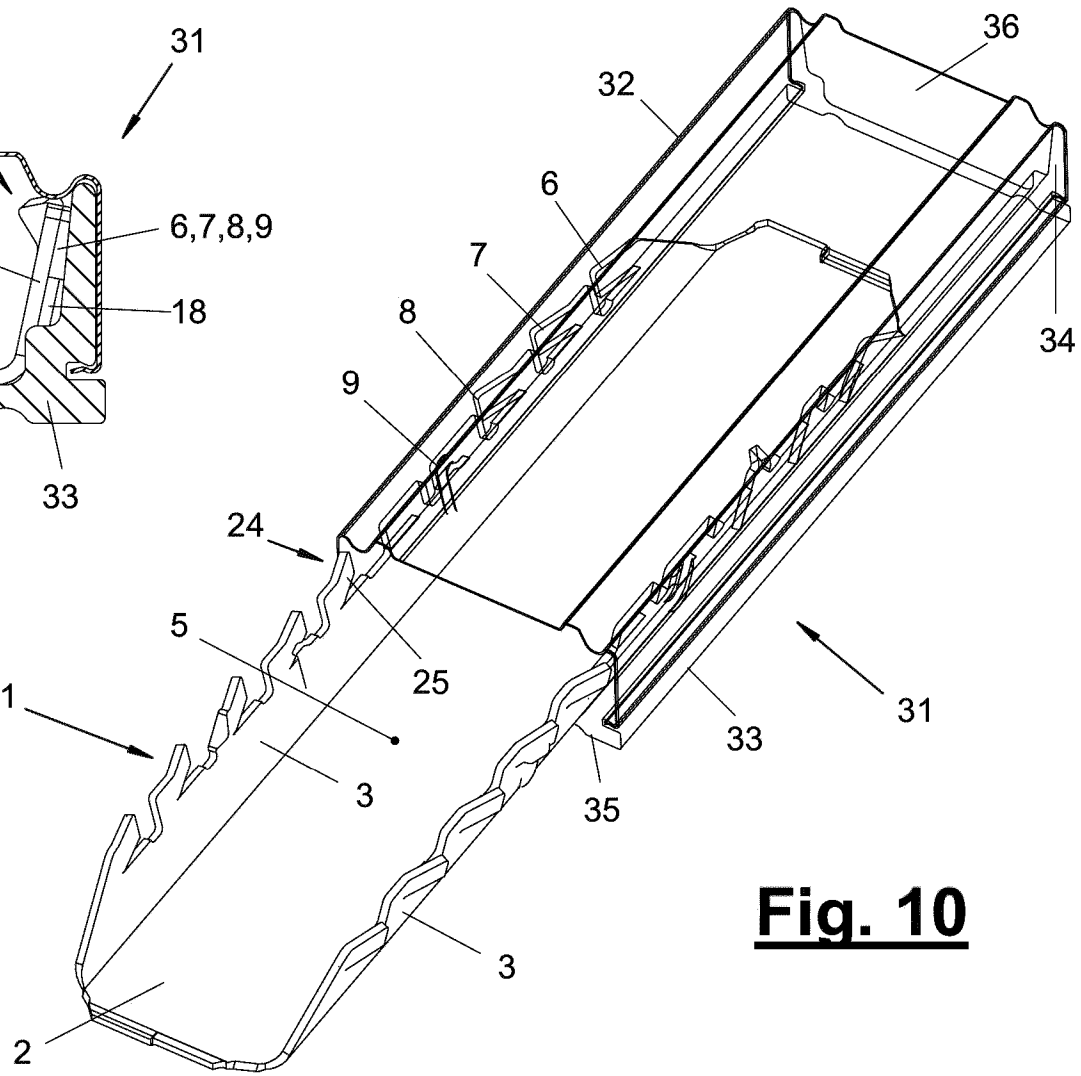
FIG. 10 is a perspective view of a hollow section end with a plugged-in plug connector.
Figure 11:
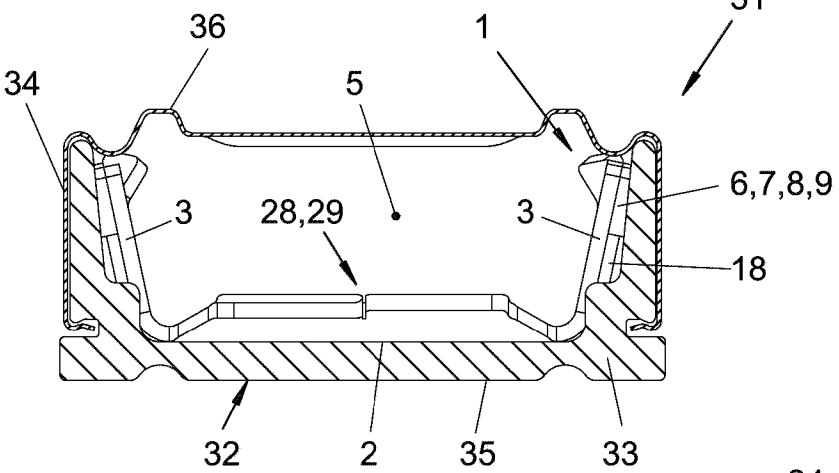
FIG. 11 is a front view of the hollow section with plugged-in plug connector.

FIGS. 10 and 11 show the plug connection (31) and the configuration of the hollow section or hollow sections (32). The hollow section or hollow sections (32) is/are preferably configured as a warm-edge hollow section. They comprise at least partially a plastic area with high heat insulation. They may have, in addition, an area made of another material, especially metal. The plug connector (1) plugged into the section end preferably comes into contact above all with the plastic area.

The hollow section (32) has, e.g., an essentially rectangular cross section with a section bottom (35), a section roof (36) and side walls. The section bottom (35) and the base (2) of the plug connector (1) point towards the inner side of the spacer frame and towards the pane inner space of the insulating glazing. The cross-sectional shape of the plug connector (1) is adapted to that of the hollow section (32) and offers a firm seating together with the retaining elements (6, 7, 8, 9) in the plugged-in position.

In the embodiment shown, the hollow section (32) has a multipart configuration and comprises, e.g., two section parts (33, 34). One section part (33) consists of plastic and the other section part (34) consists of metal, especially stainless steel. The section part (33) has, e.g., a tub-like configuration and forms the lower part of the hollow section (32). The other section part (34) is shell-shaped and has as cover-like configuration. It consists of said metal. The lower part (33) consisting of plastic forms the section bottom (35) and the side walls of the hollow section (32). The metallic upper part (34) forms the section roof (346) and overlaps the opening of the lower part (33) as well as the cavity (5) of the plug connector (1), which is open towards the roof area. The upper part (34) may have a clamp-like configuration and may also overlap an area of the side walls of the lower part (33) and may be snapped into and elastically mounted in a depression located there.

As is illustrated in FIG. 11, the base (2) of the plug connector (1), which base is closed and is, e.g., flat, lies flat on the likewise flat section bottom (35) and bridges over the connection point of the hollow section ends (32). A granulated desiccant can flow through the cavity (5) and over the connection point. Sealing against undesired inflow of granular material to the connection point is ensured by the aforementioned contact of the base and by the lateral embossing (18). These are all in contact according to FIG. 11 with the inner side wall areas of the hollow section or hollow sections (32).

FIGS. 12 through 25 show variants of the straight plug connector (1). They are largely identical to the first variant according to FIGS. 1 through 11, especially in terms of the rectangular shape of the lateral retaining elements (6, 7, 8, 9) with straight lower and upper edges (11, 12) as well as upright front edge (13). The changes will be explained below.

Figure 13:
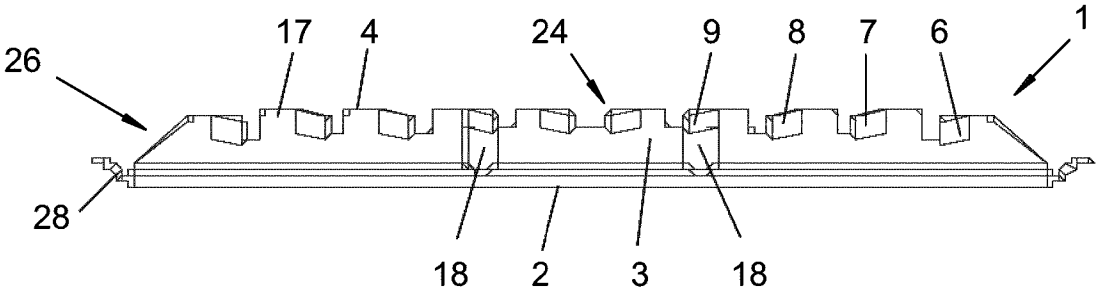
FIG. 13 is a side view of the second variant of the plug connector.
Figure 12:
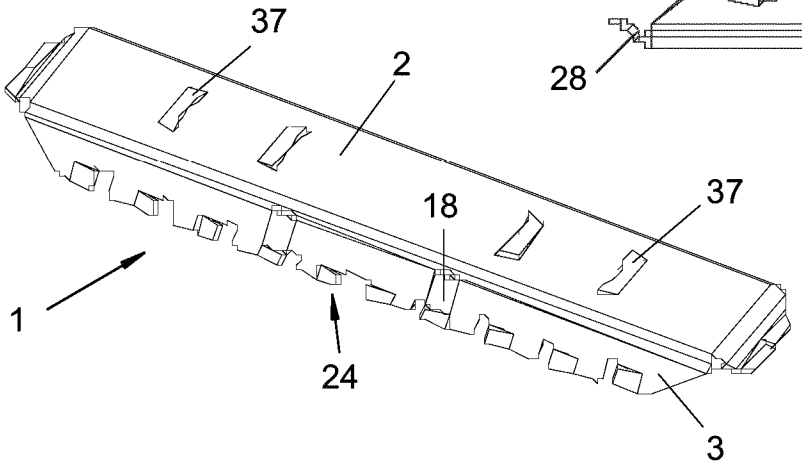
FIG. 12 is a perspective view of a second variant of the plug connector.
Figure 15:
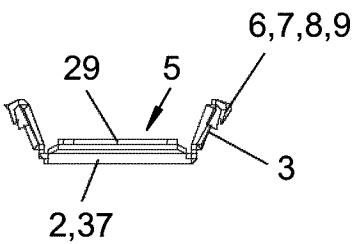
FIG. 15 is an end view of the second variant of the plug connector.
Figure 14:
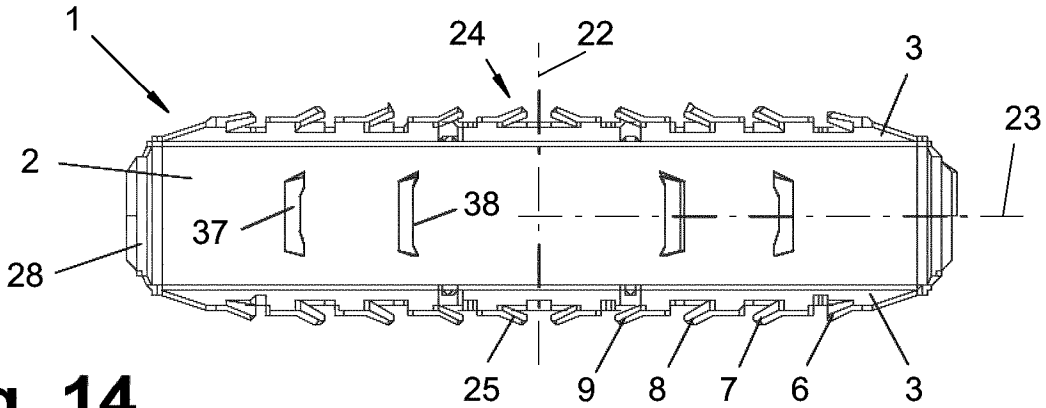
FIG. 14 is a bottom view of the second variant of the plug connector.

FIGS. 12 through 15 show a second variant of the straight plug connector (1) in a perspective view in FIG. 12 and in a side view, top view and front view in FIGS. 13 through 15.

The plug connector (1) according to the second variant differs from the first variant by the arrangement of resilient retaining elements (37) at the base (2). These are configured as resilient base bosses, which are cut out from the base (2) and are bent off. The retaining elements (37) are each directed obliquely outwards and point towards the center (22) of the connector. The retaining elements (37) can mesh with the section bottom (35) and dig in here as a result. At least one retaining element (37) each is arranged at the base (2) of the plug connector (1) on both sides of the center (22) of the connector. There are two retaining elements (37) on both sides in the exemplary embodiment being shown.

The retaining elements (37) have, when viewed in the axial direction (23), a short length. Their length is shorter than their width, especially their width at the free front edge (38). In the top view, the retaining elements or base bosses (37) may have a conical shape, which widens towards the free front edge (38). The transition point or bending point at the base (2) is narrower than the free front edge (38).

The blocking elements (21) of the first variant are absent in the second variant according to FIGS. 12 through 15. As an alternative, they may be present. The embossings (18) of the first variant are present in a modified form. They reach only the parting cut (14) and do not extend into the lateral retaining element (9).

Figure 18:
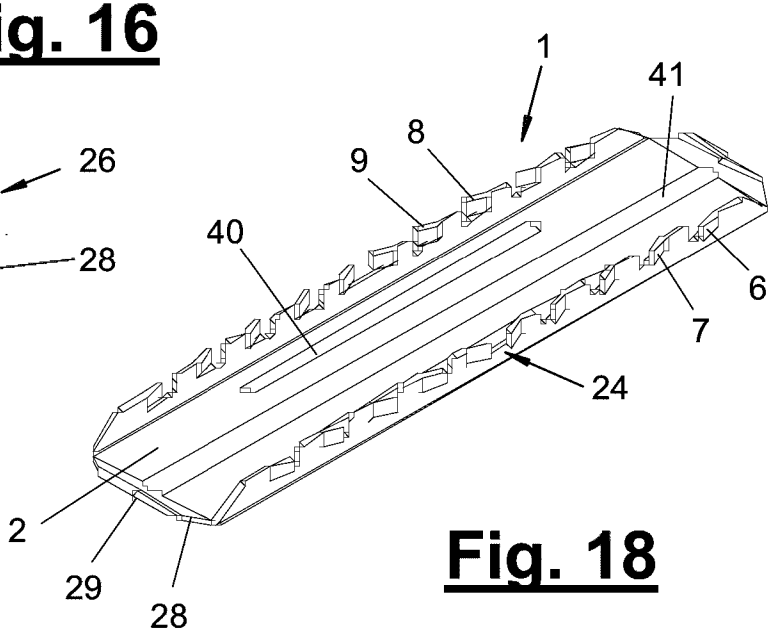
FIG. 18 is a perspective view of the third variant of the plug connector.
Figure 16:
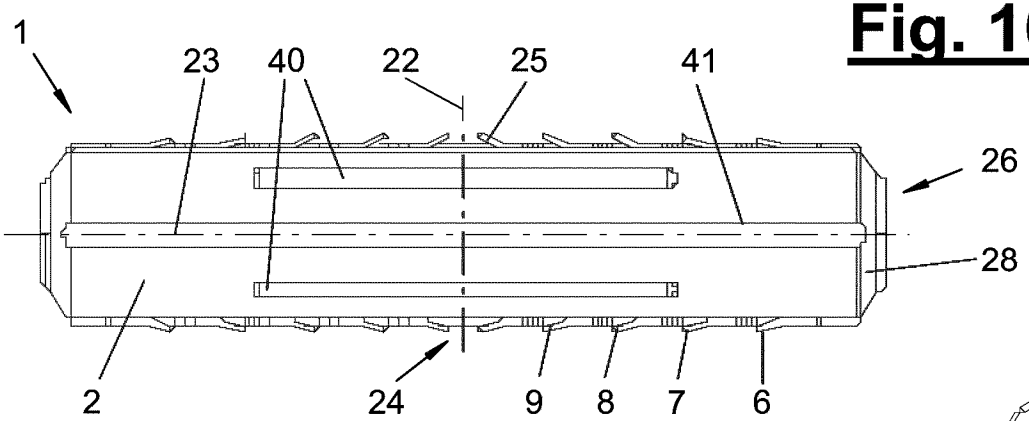
FIG. 16 is a bottom view of a third variant of the plug connector.
Figure 17:
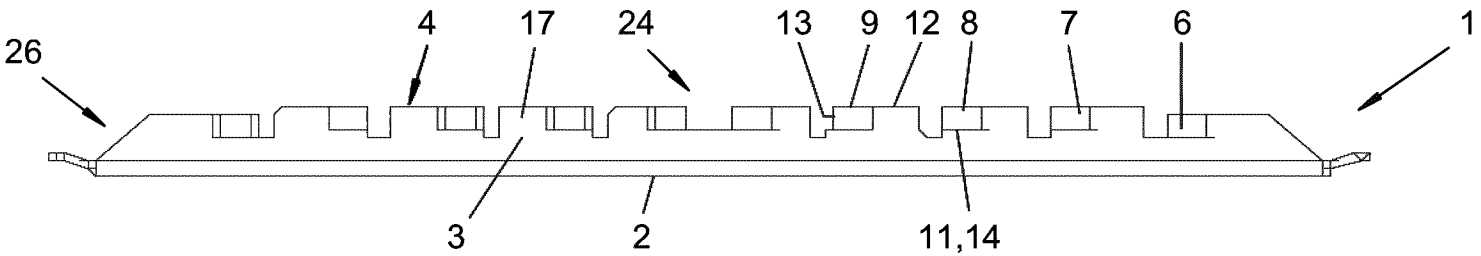
FIG. 17 is a side view of the third variant of the plug connector.

FIGS. 16 through 18 illustrate a third variant of the straight plug connector (1) in a top view and in a side view in FIG. 16 and FIG. 17 and in a perspective view in FIG. 18.

The plug connector (1) being shown here has again a closed base (2). A central groove (41) extending in the longitudinal direction (23) is located in the base (2). The base (41) is arched inwards towards the cavity (5) in the area of the groove. For example, a central row of perforations may be accommodated in the section bottom (35) in the groove (41). Bead-shaped depressions (40), which likewise extend in the longitudinal direction (23), are arranged on both sides of the groove (41). They are shorter than the length of the connector and are located in the area of the center (22) of the connector. The axial grooves (41) can bring about a reinforcement of the base (2) in the central area. In the plugged-in state, the plug connector (1) can as a result better absorb bending forces and bending torques that may develop during the handling of the spacer frame formed by the hollow section (32).

FIG. 17 illustrates in the side view the configuration of the retaining elements (6, 7, 8, 9) at the free edge (4) of the side walls (3). This configuration is the same in the variants (1, 2, 3). The retaining elements (6, 7, 8, 9) have, in agreement with FIGS. 5 and 6, said height (h1, h2) and said flaring widths (w6, w7, w8, w9). In addition, it is seen in FIG. 17 that the length of the upright front edges (13) of the retaining elements (6, 7, 8, 9) is essentially equal. This length of the front edge of the resilient stop bosses (25) of the centering aid (24) may likewise be equal.

The embossings (18) and the blocking elements (21) of the first variant are absent in the third variant. As an alternative, they may be present.

Figure 19:
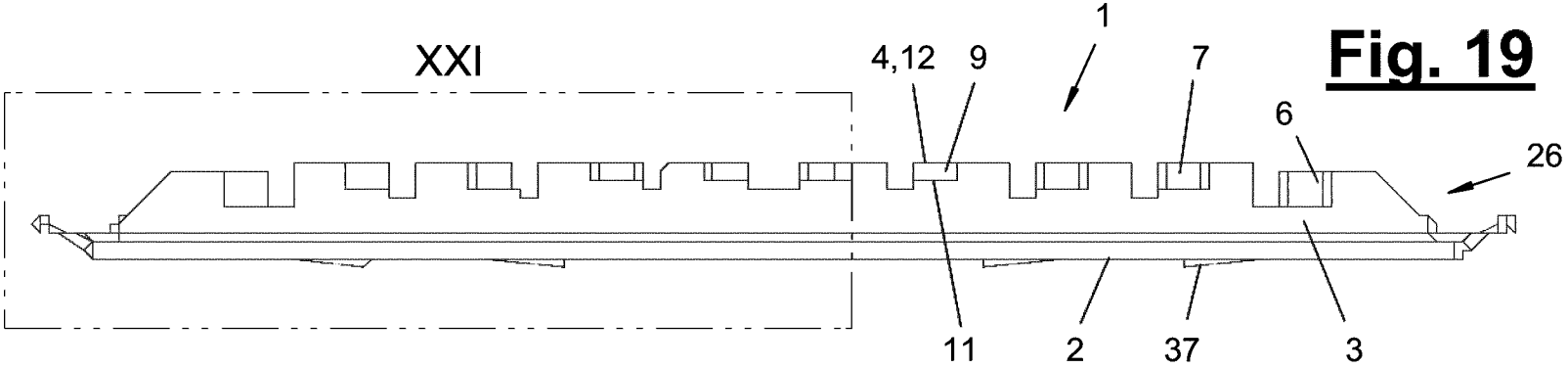
FIG. 19 is a side view of a fourth variant of the plug connector.
Figure 20:
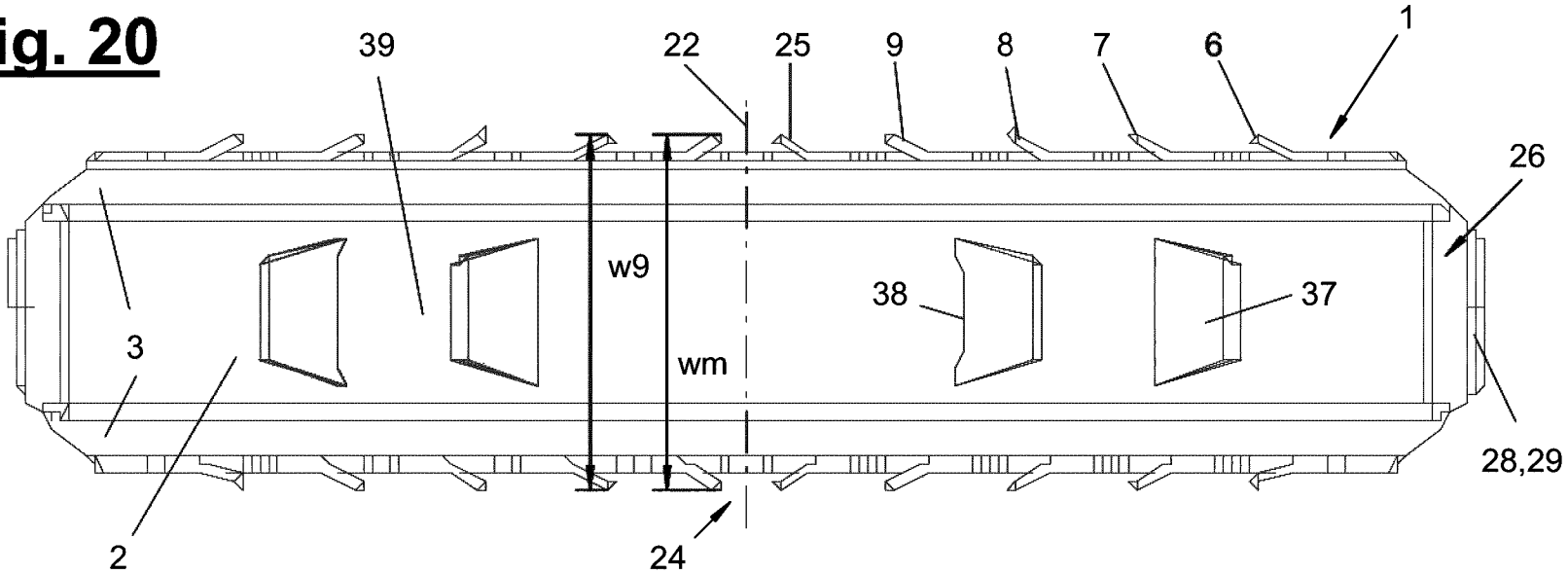
FIG. 20 is a top view of the fourth variant of the plug connector.
Figure 21:
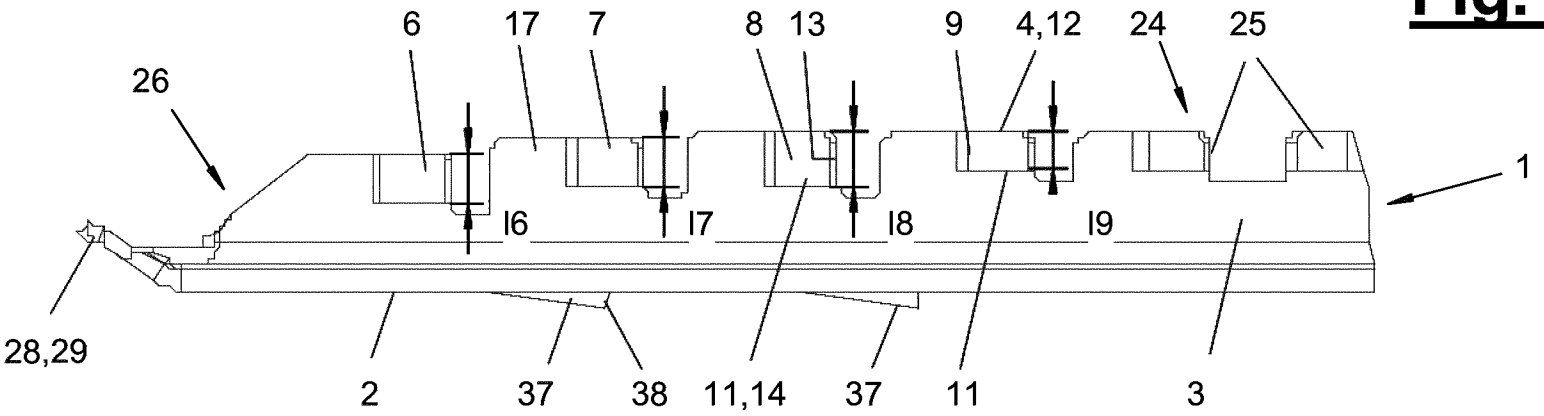
FIG. 21 is a side enlarged partial view of the fourth variant of the plug connector.
Figure 22:
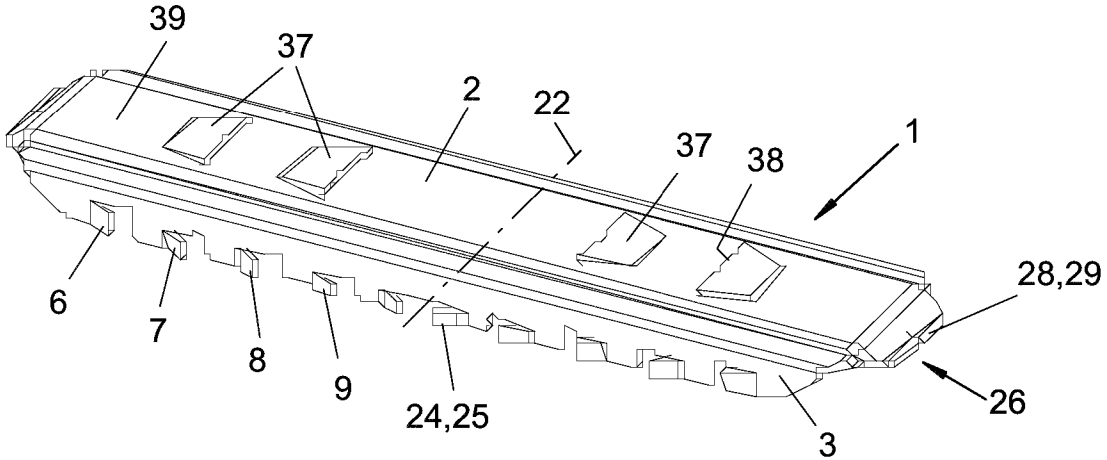
FIG. 22 is a perspective view of the fourth variant of the plug connector.

FIGS. 19 through 22 illustrate a fourth variant of the straight plug connector (1) in a side view and in a tilted top view in FIGS. 19 and 20. FIG. 21 shows a cut-away and enlarged view of detail XXI from FIG. 19. FIG. 22 is a perspective view of the plug connector (1).

In the fourth variant, the base (2) has two resilient retaining elements (37) of the above-described type each on both sides of the center (22) of the connector. The retaining elements (37) have a somewhat greater length here than in the second variant.

In the fourth variant, the base (2) has, unlike in the first variant, an outwardly directed elevation (39). It passes over the length of the plug connector (1) and is located in the central area thereof. It forms an outwardly projecting, rectangular basis at the base (2), which jumps back again at the edges. The base bosses (37) are arranged at the elevation (39).

The lateral retaining elements (6, 7, 8, 9) at the free edge (4) of the side walls (3) have again the basically identical rectangular shape in the fourth variant as in the first three variants. There is a difference in the length of the upright front edge (13). The retaining elements (9) located closest to the center (22) of the connector have each a shorter length (19) of the front edge (13) than the front edge lengths (18, 17, 15) of the retaining elements (8, 7, 6) following in the direction of the end face (26). The upper edges (12) of the retaining elements (7, 8, 9) are located here, corresponding to FIG. 6, at the same height (h2). The shortened front edge length (19) causes the side wall (3) to have at the retaining element (9) a greater web height from the base (2) to the lower edge (11) or to the parting cut (14) than in the other retaining elements (6, 7, 8). The plug connector (1) is reinforced by the greater web height in the area close to the center (22) of the connector. The retaining element (9) is more elastic than the other retaining elements (6, 7, 8) due to the shortened front edge length (19) and the correspondingly shorter bending point (10).

In addition, the front edge length (19) is essentially equal in the fourth variant to the front edge length of the resilient stop bosses (25) at the centering aid (24).

FIG. 20 illustrates another variant of the fourth variant. The lateral flaring width (w9) of the lateral retaining elements (9) located closest to the center of the connector and the flaring width (wm) of the resilient stop bosses (25) may be equal. The flaring width (wm) of the stop bosses (25) may also be smaller than the flaring width (w9). The value of the other flaring widths (w6, w7, w8) is differentiated corresponding to the first variant and FIG. 5. They are not shown in the fourth variant for the sake of clarity.

The embossings (18) and the blocking elements (21) of the first variant are absent in the fourth variant. As an alternative, they may be present.

FIGS. 23 through 25 illustrate a fifth variant of the plug connector. FIG. 24 shows a bottom view. FIG. 23 shows a perspective bottom view of the plug connector (1), and FIG. 25 shows a perspective top view into the open cavity.

In the fifth variant, the plug connector (1) has again a central elevation (39) at the base (2), which elevation forms a basis, which projects outwards from the base (2) and has an essentially rectangular contour. Further, a retaining element (37) and an additional elevation in the form of a transversely located bar (42) are arranged at the base (2) on both sides of the center (22) of the connector. The bar (42) is adjacent to the end face (26), and the retaining element (37) is located between the bar (42) and the central elevation (39). The central elevation (39) and the bars (42) may have a depression or recess in the center. A central row of perforations may be accommodated here at the section bottom (35). The free front edge of the retaining elements (37) may likewise have such a recess.

The embossings (18) and the blocking elements (21) of the first variant are absent in the fifth variant. As an alternative, they may be present.

Various modifications of the embodiments shown and described are possible. In particular, the features of the exemplary embodiments and of the modifications mentioned may be combined, and especially also replaced with one another as desired.

The configurations of the outer surface of the connector base (2) and of the inner surface of the section bottom (35) may be adapted to one another. The adapted, especially complementary contouring with peaks and valleys, which is shown in the other variants, may be present here instead of the flat shape shown. The number of the retaining elements (6, 7, 8, 9) at the connector legs and in the arrangements of rows at the side walls (3) on both sides of the center (22) of the connector are variable as well. The ratios of the flaring widths (w6, w7, w8, w9) and of the heights (h1, h2) may be variable as well. The plug connection (31) and the hollow section (32) may likewise be modified. The hollow section may have a different cross-sectional shape and a different material, e.g., a light metal alloy, steel, stainless steel or the like. It may be manufactured, for example, as an extruded section or rolled section.

While specific embodiments of the invention have been shown and described in detail to illustrate the application of the principles of the invention, it will be understood that the invention may be embodied otherwise without departing from such principles.

The invention claimed is:

1. A plug connector for hollow sections of spacers of insulating glazing, the plug connector comprising:

a base;

side walls, the base and the side walls providing an essentially U-shaped cross section with open end faces; and with the base directed towards a pane inner space when installed as well as with the side walls along free edges of the side wall; and a centering aid;

laterally flared, resilient retaining elements arranged at the free edge of the side walls, the retaining elements having a straight lower edge and a straight upper edge viewed from a plug connector side, wherein the lower edge and the upper edge extend parallel to the base; and wherein the retaining elements have a rectangular shape viewed from a plug connector side, the retaining elements being separated from a retaining element side wall on an underside by a straight axial parting cut, the side walls having a row of four or more of the retaining elements.

2. A plug connector in accordance with claim 1, wherein a length of the retaining elements is greater than a height thereof.

3. A plug connector in accordance with claim 1, wherein the retaining elements have a straight and upright front edge, which extends parallel to the principal plane of the side wall.

4. A plug connector in accordance with claim 1, wherein the retaining elements have a rounded transition between a retaining element upper edge and a retaining element front edge.

5. A plug connector in accordance with claim 1, wherein the retaining elements are flared from a retaining element side wall laterally obliquely outwards and pointing towards a center of the connector.

6. A plug connector in accordance with claim 5, wherein the side wall has a free space in front of each retaining element front edge of the retaining elements.

7. A plug connector in accordance with claim 6, wherein the free space on an underside has a recess extending under the parting cut.

8. A plug connector in accordance with claim 1, wherein pairs of the retaining elements located opposite each other on both sides of a central longitudinal axis of the plug connector have different flaring widths, which increase from the end face to a center of the connector.

9. A plug connector in accordance with claim 1, wherein the centering aid comprises resilient stop bosses and a flaring width of the resilient stop bosses of the centering aid is equal to or smaller than a flaring width of a respective retaining element located closest thereto.

10. A plug connector in accordance with claim 1, wherein the retaining elements arranged at the side walls on both sides of a center of the connector have different heights above the base.

11. A plug connector in accordance with claim 1, wherein the respective retaining element arranged at the end face has a smaller height above the base than a height of the retaining elements which follow the retaining element arranged at the end face, farther in an axial direction towards a center of the connector.

12. A plug connector in accordance with claim 11, wherein the other retaining elements following in the axial direction towards the center of the connector have each the same height above the base.

13. A plug connector in accordance with claim 1, wherein the respective retaining element located closest to the center of the connector has a shorter length of a front edge thereof than other retaining elements following the respective retaining element located closest to the center, in the direction of the end face.

14. A plug connector in accordance with claim 1, wherein the side walls on both sides of the center of the connector have an outwards directed embossing.

15. A plug connector in accordance with claim 1, wherein an embossing is arranged in an area of a retaining element located closest to a center of the connector.

16. A plug connector in accordance with claim 15, wherein the embossing has an embossed area at the side wall and an embossed area at a flared retaining element.

17. A plug connector in accordance with claim 1, wherein an inwardly directed blocking element is arranged at each of the side walls.

18. A plug connector in accordance with claim 1, wherein a blocking element is arranged as an obliquely bent-off blocking boss at a wall attachment after one of the retaining elements.

19. A plug connector in accordance with claim 1, wherein the plug connector has open end faces and an axially continuous inner cavity.

20. A plug connector in accordance with claim 1, wherein the side walls are directed obliquely outwards.

21. A plug connector in accordance with claim 1, wherein at each of the end faces a base tongue with a stabilizing element is provided.

22. A plug connector in accordance with claim 1, wherein the base comprises a closed base.

23. A plug connector in accordance with claim 1, wherein the plug connector has at the base one or more resilient retaining elements, with each directed obliquely outwards and pointing towards a center of the connector.

24. A plug connector in accordance with claim 23, wherein a length of the retaining elements is shorter than a width thereof.

25. A plug connector in accordance with claim 1, wherein the plug connector is configured as a stamped and bent part made of a metal plate galvanized steel strip;

the rectangular shape of each of the retaining elements is in a plane of a respective one of the retaining elements.

26. A plug connector in accordance with claim 1, wherein the straight axial parting cut is a narrow parting cut extending parallel to the base and to the longitudinal axis and reaching with one of its ends a bending line of the retaining element, wherein the end has a sharp edge.

27. A plug connector in accordance with claim 1, wherein the parting cuts and the lower edges of the retaining element located at the end face are arranged deeper than in the other retaining elements.

28. A plug connector for hollow sections of spacers of insulating glazing, the plug connector comprising:

a base;

side walls, the base and the side walls providing an essentially U-shaped cross section with open end faces; and with the base directed towards a pane inner space when installed as well as with the side walls along free edges of the side wall;

a centering aid;

laterally flared, resilient retaining elements arranged at the free edge of the side walls, and the retaining elements having a straight lower edge and a straight upper edge viewed from a plug connector side, wherein the lower edge and the upper edge extend parallel to the base; and wherein the retaining elements have a rectangular shape viewed from a plug connector side, the respective retaining element located closest to the center of the connector has a shorter length of a front edge thereof than other retaining elements following the respective retaining element located closest to the center, in the direction of the end face.

29. A plug connector for hollow sections of spacers of insulating glazing, the plug connector comprising:

a base;

side walls, the base and the side walls providing an essentially U-shaped cross section with open end faces; and with the base directed towards a pane inner space when installed as well as with the side walls along free edges of the side wall;

a centering aid;

laterally flared, resilient retaining elements arranged at the free edge of the side walls, and the retaining elements having a straight lower edge and a straight upper edge viewed from a plug connector side, wherein the lower edge and the upper edge extend parallel to the base; and wherein the retaining elements have a rectangular shape viewed from a plug connector side, the retaining elements being separated from a retaining element side wall on an underside by a straight axial parting cut, the parting cuts and the lower edges of the retaining element located at the end face being arranged deeper than in the other retaining elements.

* * * * *